United States Patent [19]

McMullin

[11] Patent Number: 4,624,312

[45] Date of Patent: Nov. 25, 1986

[54] REMOTE CEMENTING PLUG LAUNCHING SYSTEM

[75] Inventor: Kurt M. McMullin, Duncan, Okla.

[73] Assignee: Halliburton Company, Duncan, Okla.

[21] Appl. No.: 617,426

[22] Filed: Jun. 5, 1984

[51] Int. Cl.[4] ..... E21B 33/16

[52] U.S. Cl. ..... 166/155; 166/153; 166/285

[58] Field of Search ..... 166/153, 154, 155, 156, 166/192, 193, 196, 285, 291; 285/302, 32; 138/119, 120, 155

[56] References Cited

U.S. PATENT DOCUMENTS

| | | | |
|---|---|---|---|
| Re. 29,830 | 11/1978 | Scott | 166/155 |
| 3,354,950 | 11/1967 | Hyde | 285/302 |
| 3,605,896 | 9/1971 | Perkins | 166/154 |
| 3,616,850 | 11/1971 | Scott | 166/155 |
| 3,635,288 | 1/1972 | Lebourg | 166/156 |
| 3,730,267 | 5/1973 | Scott | 166/291 X |
| 3,796,260 | 3/1974 | Bradley | 166/153 |
| 3,910,349 | 10/1975 | Brown et al. | 285/302 X |
| 3,915,226 | 10/1975 | Savage | 166/152 |
| 4,042,014 | 8/1977 | Scott | 166/362 |
| 4,047,566 | 9/1977 | Duke | 166/88 |
| 4,164,980 | 8/1979 | Duke | 166/291 |
| 4,194,765 | 3/1980 | Reddy | 285/27 |
| 4,479,544 | 10/1984 | Callihan et al. | 166/153 X |
| 4,487,263 | 12/1984 | Jani | 166/154 X |

*Primary Examiner*—Stephen J. Novosad
*Assistant Examiner*—David J. Bagnell
*Attorney, Agent, or Firm*—Joseph A. Walkowski

[57] ABSTRACT

The present invention comprises an improved remote cement plug launching system including guide tube means associated with the cementing plugs, which guide tube means are adapted to guide plug release darts to seats in said plugs.

13 Claims, 5 Drawing Figures

REMOTE CEMENTING PLUG LAUNCHING SYSTEM

BACKGROUND OF THE INVENTION

In cementing casing in well bores of subsea oil and gas wells, it is common industry practice to employ a cement plug launching device near the top of the well bore casing, which may be as much as several thousand feet below the water surface, rather than launching the plugs from the floor of the offshore platform. There are several major reasons for launching plugs remotely, through drill pipe extending from the platform to an installation tool at or near the top of the well bore casing, even though it is difficult if not impossible to ascertain from the rig floor on the platform if the launching device has operated properly. First, well casing is of relatively thin wall construction and large diameter, with threaded connections designed for permanent installation in a well bore, rather than ease of assembly and disassembly. Therefore, running casing from the platform to the sea floor is difficult and expensive. In addition, after the well is cemented, the casing run between the platform and the sea floor would have to be retrieved, and returned to shore, there being no further use therefor. Of course, there is also the initial problem of transporting casing to the platform in the first instance. Finally, once casing has been used, many well operators will not permit subsequent reuse on another well for safety and reliability reasons; therefore the cost of casing for use in one well becomes prohibitive. Using a remote plug launching device actuated via drill pipe from the platform to the device instead of casing, affords several major advantages: drill pipe is of relatively small diameter and of sturdy construction, permitting ease of handling and greater safety; drill pipe has threads machined for rapid and repeated connection and disconnection; the use of drill pipe permits inclusion of telescoping slip joints or bumper subs in the pipe string in order to compensate for the vertical motion of the platform imparted by wave action.

The major disadvantage of employing a remote cement plug launching device is, as previously noted, the possibility that the device will operate improperly without detection by the well operator. For example, the launching device may prematurely release one or more of its plugs, or fail to release a plug at all.

One remote plug launching device designed to avoid these operability problems is disclosed in U.S. Pat. No. 3,915,226 to Ronald E. Savage, assigned to the assignee of the present application, and incorporated herein by reference. This prior art device comprises a double-collet type release mechanism which ensures reliable release of the top, or cement displacement plug from the drill pipe. However, the release of the bottom, or fluid displacement, plug is effected by using a free-fall ball which is placed in the drill pipe at the surface, and allowed to fall to the bottom plug, wherein it seats, and subsequent application of pressure in the drill pipe shears pins holding the bottom plug to the top plug, releasing the former. This use of a free-fall type ball, however, presents a problem in deeper offshore wells where the volumetric capacity of the drill pipe is greater than the volume of spacer fluid run ahead of the cement pumped thereafter, due to the uncertainty as to when the ball will reach the bottom plug, the tendency of the spacer fluid to incompletely displace the drilling and below it in the well, and the inability of the ball to wipe the inner wall of the drill pipe clean of mud, all of which result in the presence of mud above the bottom plug when it is released, with consequential mud contamination of the cement following the bottom plug.

A number of other prior art plug launching devices suffer from the same enumerated disadvantages, including those disclosed in U.S. Pat. Nos. RE 29,830, 3,616,850, 3,730,267, 4,042,014, 4,047,566 and 4,164,980.

One solution to the aforementioned use of a freefall ball to release a bottom plug is suggested in U.S. Pat. No. 3,796,260, issued to B. Jack Bradley, assigned to the assignee of the present invention, and incorporated herein by reference. The Bradley patent discloses the use of drill pipe plugs or darts which are pumped down the drill pipe to the cementing plugs, the cementing plugs having differently sized seats therein, with the lowermost cementing plug having the smallest seat. With such a design, a dart sized to move through the seats one or more cementing plugs above the bottom plug will seat on the bottom plug, and shear a pin, which releases the bottom plug. Thereafter, when desired, the next-larger dart is pumped down the drill pipe to seat in the lowermost remaining plug, and so on.

While a device such as is disclosed in the Bradley patent presents no problems with cementing plugs employed in small-size casing (under approximately seven (7) inches internal diameter), with larger casing the operator cannot be sure that the darts will consistently enter the seats in the centers of the cementing plugs and effect release of the plugs.

SUMMARY OF THE INVENTION

In contrast to the prior art, the present invention comprises an improved remote plug launching system operated by drill pipe plugs or darts which is suitable for use even in extremely large size casing. The present invention comprises the inclusion of a telescoping guide tube between adjacent stacked plugs. The guide tube assures proper orientation of each dart with respect to its cooperating seat in a cementing plug, while the telescoping feature allows seating of an upper cementing plug on a lower one by moving upwardly out of the way when encountering an obstruction protruding upward from the lower cementing plug, such as the dart seated therein.

BRIEF DESCRIPTION OF THE DRAWINGS

The present invention will be more readily understood by one of ordinary skill in the art through a review of the following detailed description of the preferred embodiment, taken in conjunction with the accompanying drawings, wherein.

DETAILED DESCRIPTION OF THE PREFERRED EMBODIMENT

Figure 1:
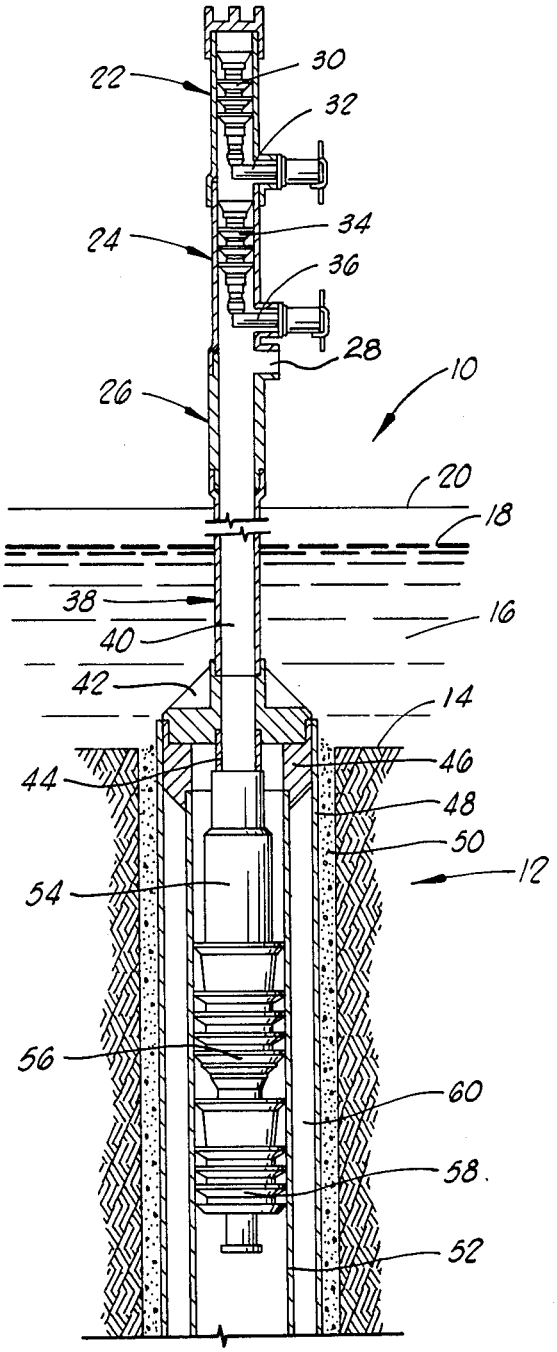
FIG. 1 is a schematic illustration of cementing plugs employing the present invention suspended in a subsea well bore prior to being released by drill pipe plugs or darts pumped down the drill pipe running from above the water surface.

Referring to FIG. 1, a subsea cement plug release system 10 including the present invention is shown schematically. Well bore 12 extends from sea floor 14 downward, with water 16 thereover, above the surface 18 of which is rig floor 20 supporting plug containers 22 and 24 over manifold 26 having cement inlet 28 therein. Plug container 22 contains top dart 30, which is held in place by retractable plunger 32, while plug container 24 holds bottom dart 34, supported by retractable plunger 36.

Drill pipe 38 having bore 40 therein extends from manifold 26 on rig floor 20 to installation tool 42. Cementing head adapter 44 is suspended from installation tool 42, and is surrounded by casing hanger 46 which is secured by means well known in the art within outer casing 48, which has previously been cemented into well bore 12 with cement sheath 50. Casing hanger 46 supports inner casing 52, while cementing head adapter 44 has top plug release assembly 54 suspended therefrom. Top cementing plug 56 is releasably secured to release mechanism 54, while bottom plug 58 is releasably secured to top plug 56. The apparatus as shown will be employed to cement the inner casing 52 within outer casing 48 by the introduction of cement into the annulus 60 therebetween. Of course, the present invention may be employed with cementing plugs utilized to cement outer casing within a well bore annulus, or a liner within an inner or outer casing hundreds or thousands of feet below a sea floor 14.

Figure 2:
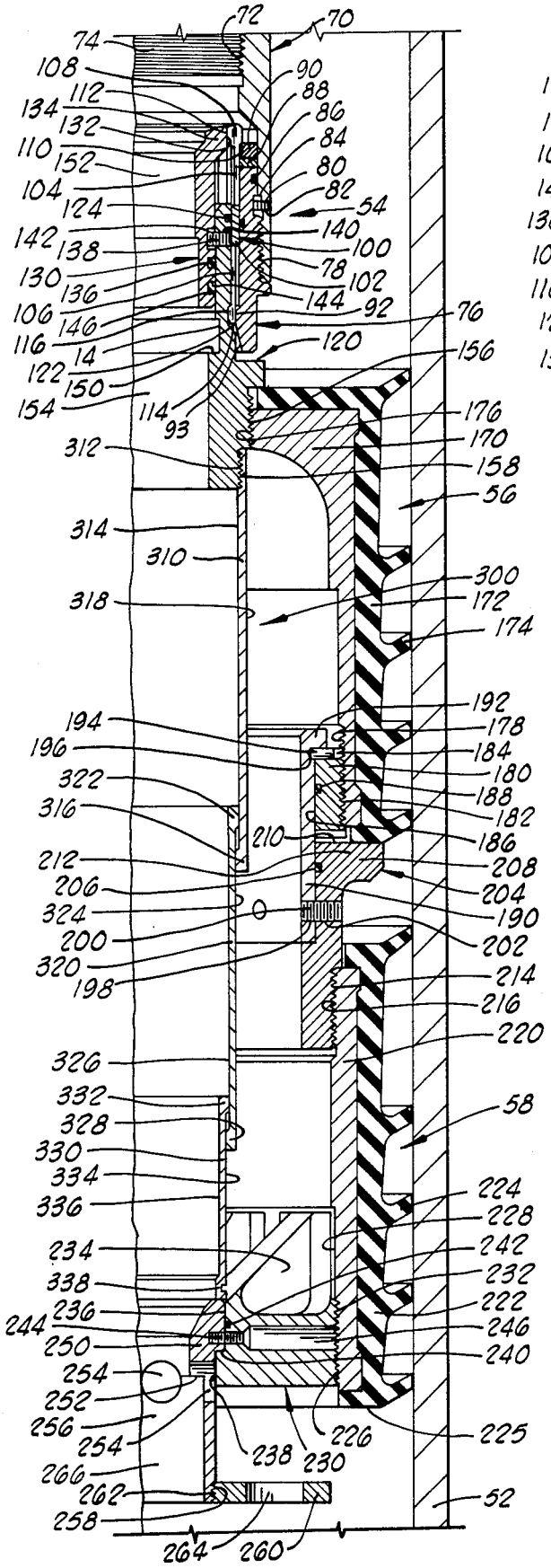
FIG. 2 is a vertical sectional elevation of the top and bottom cementing plug as shown in FIG. 1, the upper plug including the guide tube of the present invention.
Figure 3:
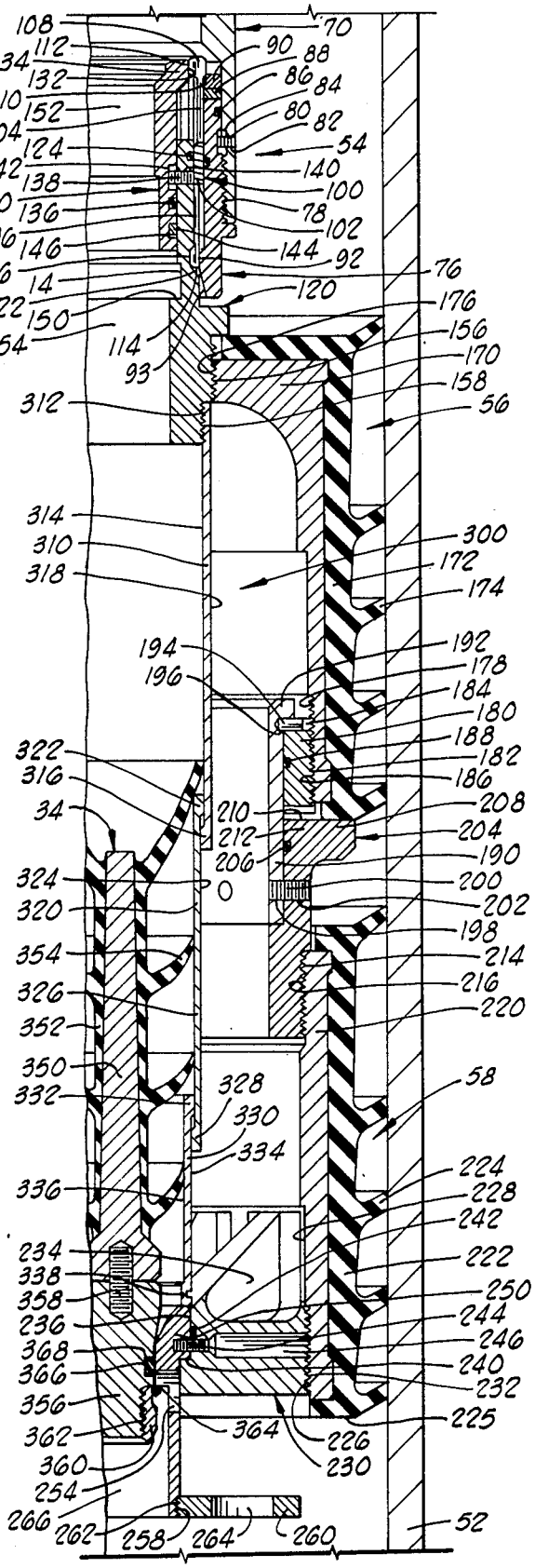
FIG. 3 is a view similar to FIG. 2, but with a dart seated in the bottom plug.
Figure 4:
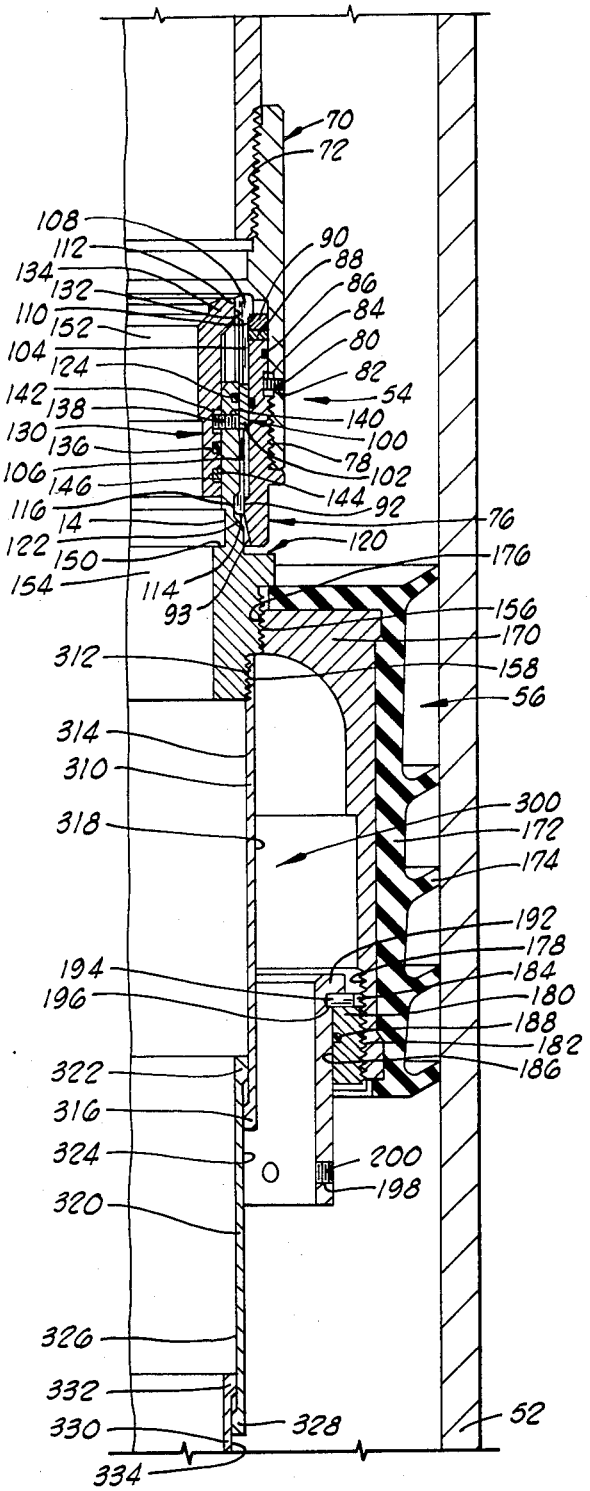
FIG. 4 depicts the top plug after the bottom plug has been released therefrom.

Referring to FIG. 2 of the drawings, top plug release assembly 54 is shown at the top thereof. Assembly 54 includes case 70 having threads 72 therein and bore 74 extending therethrough. Threads 72 secure assembly 54 to cementing head adapter 44 (not shown). Case 70 surrounds retaining nut 76, which extends upwardly therein and is threaded thereto at 78. Set screw 80 extends through threaded aperture 82 in the wall of case 70, and bears against flat 84 on the exterior of retaining nut 76 to prevent rotation between case 70 and nut 76. O-ring 86 seals between case 70 and nut 76. Annular thrust bearing 88 rests on the top of nut 76, over which lies bearing race 90. The interior diameters of bearing race 90, thrust bearing 88 and the upper portion of nut 76 are substantially the same. The lower portion of nut 76 extends inwardly at annular shoulder 92, which flares outwardly at 93 on its lower end to the bottom of nut 76.

Collet sleeve 100 is disposed within release adapter 76, collet sleeve 100 including a solid center ring 102 from which extend upwardly a first plurality of collet fingers 104, and downwardly a second plurality of collet fingers 106. Fingers 104 end in lugs 108, which extend radially outwardly, resting at 110 on bearing race 90 and radially inwardly to longitudinally oriented flat faces 112. Fingers 106 terminate in lugs 114, which only protrude radially inwardly to flat faces 116.

Release adapter 120 is disposed within collet sleeve 100, lugs 114 of lower collet fingers 106 resting in annular recess 122 on the exterior of release adapter 120. O-ring 124 seals between the exterior of release adapter 120 and the interior of sleeve ring 102.

Releasing sleeve 130 is disposed within the ring of upper collet fingers 104 at its upper extent, and within release adapter 120 at its lower extent. Flat faces 112 on lugs 108 bear inwardly against outer annular surface 132 at the top of releasing sleeve 130. Sleeve 130 necks down to a lesser diameter below annular lip 134 on which surface 132 is located, there being a seal effected between release adapter 120 and releasing sleeve 130 by O-ring 136. Above O-ring 136, threaded brass shear rods 138 (one shown) extend through threaded aperture 140 in the wall of adapter 120 into annular recess 142 on the exterior of releasing sleeve 130. Below O-ring 136 is lock ring 144 in recess 146 on the exterior of releasing sleeve 130. Below the bottom of releasing sleeve 130, release adapter 120 possesses a shallow annular recess 148, terminating at annular bottom wall 150, the purpose for which will be explained hereafter.

Releasing sleeve 130 defines bore 152, which is contiguous with bore 74 of case 70. Below releasing sleeve 130, release adapter 120 defines bore 154, which extends to the bottom of plug release assembly 54, whereat stepped threaded portions 156 and 158 are located on the exterior of release adapter 120.

Top cementing plug 56 comprises plug body 170 having elastomeric sleeve 172 bonded to the exterior thereof. Elastomeric sleeve 172 possesses a plurality of annular wiper flaps 174 sized to resiliently press against the interior of inner casing 52, so as to wipe it clean of mud and other contaminants prior to passage of the cement which follows. The interior of plug body 170 has threads 176 at its upper end, which engage threaded portion 156 on release adapter 120.

Plug body 170 has internal threads 178 on its lower interior, which threads engage threads 182 on the outside of retainer sleeve nut 180. Nut 180 possesses two diametrically opposed slots 184 (one shown) in the top thereof, and a smooth inner surface 186 in which O-ring 188 is housed in an annular groove. Tubular bottom plug retaining sleeve 190 is positioned inside nut 180, with flange 192 extending radially outward over the top thereof. Retainer pins 194 (one shown) lie in slots 284 and extend into recesses 196 in sleeve 190.

The bottom of bottom plug retaining sleeve 190 extends below top plug 56, whereat shear pin apertures 198 extend therethrough, a plurality of shear pins 200 extending from sleeve 190 radially outwardly into holes 202 in the wall of plug seat 204 at the top of bottom plug 56. O-ring 206 seals between retaining sleeve 190 and seat 204. The top of seat 204 comprises a radially outwardly extending flange 208 having a radially flat upper surface 210, which contacts the bottom 212 of elastomeric sleeve 172 on top plug 54.

The lower exterior of seat 204 possesses threads 214 thereon, which mate with internal threads 216 on the body 220 of bottom plug 58. Plug body 220, like body 170, carries an elastomeric sleeve 222 thereon having a plurality of annular wiper flaps 224 thereabout in contact with inner casing 52. The lower interior of bottom plug body 220 has threads 226 cut therein, which engage exterior threads 232 on the lower portion of retainer sleeve bushing 230. Shallow recess 228 above plug body threads 226 accommodates a plurality of radially-extending buttresses 234 on the top of bushing 230.

The interior of bushing 230 defines a stepped bore having upper wall 236, lower wall 238 and annular shoulder 240 therebetween. O-ring 242 rests in an annular groove (unnumbered) opening into upper wall 236, and provides a seal against the exterior of bottom dart seat 250. A plurality of shear screws 244 (one shown) extend from lateral bores 246 in bushing 230 into bottom dart seat 250. Below shear screws 244, bottom dart seat 250 extends over annular shoulder 240 on bushing 230, resting thereon and maintained in place by screws 244. Below shoulder 240, and adjacent lower wall 238, circulation ports 254 extend from the interior 256 of dart seat 250 through annular shoulder 252 to the exterior thereof. At the lower end of dart seat 250, threads 258 engage threads 262 on circular extension plate 260, which has a plurality of apertures 264 therethrough spaced about central bore 266, which communicates with the interior of seat 250.

Returning to the bottom of plug release assembly 54, guide tube 300 of the present invention engages threads 158 on the bottom of release adapter 120. Guide tube 300, having bore 302 therethrough, comprises a plurality of slidably interlocking, telescoping tubular sections 310, 320 and 330. Top section 310 is the largest of three sections, having internal threads 312 at the top of the interior wall 314. The bottom of wall 314 terminates at annular lip 316. The exterior wall 318 of section 310 is of substantially uniform diameter. Middle section 320 possesses exterior annular lip 322 at the top of its exterior wall 324, lip 322 being of slightly lesser diameter than interior wall 314 of section 310, while exterior wall 324 is of slightly lesser diameter than the interior of lip 316 of section 310. The bottom of middle section 320 carries annular lip 328 on its interior, above which interior wall 326 extends to the top thereof.

Bottom section 330 possesses exterior annular lip 332 at its top, which lip is of slightly lesser diameter than interior wall 326 of middle section 320. Below lip 332, exterior wall 334 of slightly lesser diameter than interior lip 328 of middle section 320 extends to the bottom of bottom section 330. Interior wall 336 of bottom section 330 extends substantially uniformly to interior annular lip 338.

As shown in FIG. 2, sections 310, 320 and 330 of guide tube 300 are substantially fully telescoped longitudinally outward, top section 310 being secured to release adapter 120, top section 310 being slidably locked to middle section 320 via lips 316 and 324, middle section 320 being slidably locked to bottom section 330 via lips 328 and 332, and the bottom of bottom section 330 rests upon the top of plug seat 250. Thus, a continuous, confined longitudinal path is provided from the bore 154 of release adapter 120 to plug seat 250.

OPERATION OF THE PREFERRED EMBODIMENT

Referring to FIGS. 1-5, cementing plugs 56 and 58 are suspended in inner well bore casing 52 from top plug release assembly 54 in anticipation of cementing the annulus 60 between outer casing 48 and inner casing 50. Initially, a spacer fluid is pumped through manifold 26 into drill pipe 38 to displace drilling mud therein. When the desired volume of spacer fluid has been pumped, plunger 36 of plug container 24 is retracted and bottom dart 34 is released into drill pipe 38, immediately followed by cement pumped through manifold 26. As bottom dart 34 moves down drill pipe 38, it wipes the inner wall thereof of mud and other contaminants. When bottom dart 34 reaches top plug release assembly 54, it passes therethrough via bores 74, 152 and 154 into guide tube bore 302, wherein it travels to bottom plug seat 250.

Bottom dart 34 includes body 350 having elastomeric sleeve 352 bonded thereto, wiper flaps 354 protruding outwardly therefrom. Body 350 is secured to nose 356 by screw 358, nose nut 360 being threaded to nose 356 at 362, split lock ring 364 being held on nose 356 by nut 360. O-ring 366 in annular groove 368 provides a seal between plug seat 250 and nose 356 when dart 34 enters dart seat 250 (FIG. 2). Lock ring 364 secures dart 34 in dart seat 250 when it expands after passing shoulder 252, to lock dart 34 to bottom cementing plug 58.

Continued application of pressure to the joined assembly of dart 34 and cementing plug 58 will result in the shearing of shear screws 200 connecting plug seat 204 to retaining sleeve 190, and the release of bottom cementing plug 58 from top cementing plug 56 (see FIG. 4) after which bottom plug 58 is displaced to a float shoe or collar (not shown) such as is well known in the art at the bottom of inner casing 52. A suitable float collar, by way of example and not limitation, is the Super Seal Float Collar, manufactured by Halliburton Services, Duncan, Okla. Upon striking the top of the float shoe, extension plate 260 at the bottom of dart seat 250 is forced relatively upward with respect to retainer sleeve bushing 230, shearing screws 244 with subsequent relative upward movement of dart seat 250 carrying dart 34, which opens communication through circulation ports 254 between the cement above plug 58 and interior 256 of dart seat, with subsequent flow of the cement through the float collar or shoe, and into annulus 60.

When sufficient cement has been pumped into drill pipe 38 and down into inner casing 52 to fill annulus 60, top dart 30 is released from plug container 22 by retraction of plunger 32, after which a displacement fluid such as drilling mud, is pumped through manifold 26 after top dart 30.

Top dart 30 is displaced down drill pipe 38 to top plug release assembly 54, wherein it seats inside of releasing sleeve 130. Top dart 30 is similar to bottom dart 34, having a body 380 with an elastomeric sleeve 382 bonded thereto, sleeve 382 having wiper flaps 384 protruding therefrom. Nose 386 is threaded to body 380 at 388, and nose nut 390 holding split lock ring 392 on nose 386, being secured thereto at threaded connection 394. O-ring 396 rests in annular groove 398 on the exterior of nose 386. O-ring 396 provides a seal between releasing sleeve 130 and top dart 30, sealing off bore 154 from bore 74 above.

Figure 5:
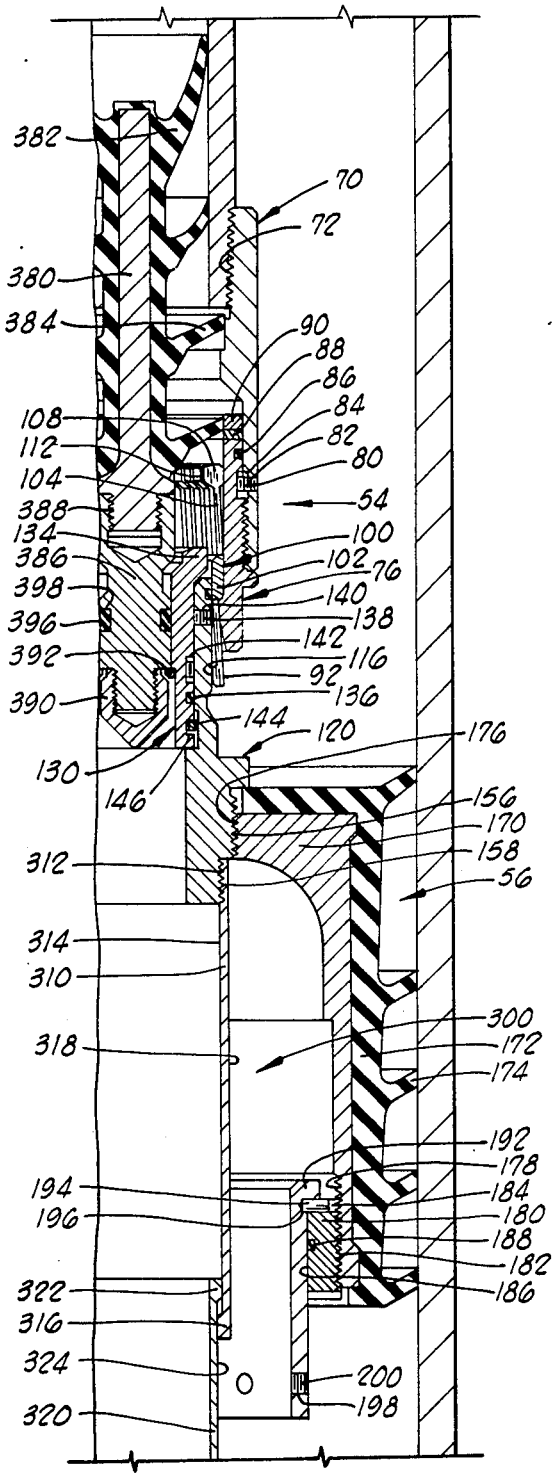
FIG. 5 shows the top plug in the process of releasing from the drill pipe after its associated dart has seated.

When a predetermined release pressure is reached in bore 74, a sufficient downward force is reached to cause shearing of brass shear rods 138 with subsequent downward displacement of releasing sleeve 130 to rest on bottom wall 150, and outward expansion of lock ring 144 into shallow annular recess 148 (FIG. 5). Movement of releasing sleeve 130 away from upper collet fingers 104 and lugs 108 permits inward biasing of fingers 104 away from bearing race 190, allowing downward movement of collet sleeve 100 carrying top dart 30 until sleeve 100 bottoms on annular shoulder 92. As collet sleeve 100 moves downward, lower collet fingers 106 encounters flared area 93 which removes the radially inward bias of lugs 114 into annular recess 122, resulting in the movement of release adapter 120 down past collet sleeve 100, and the release of top plug 56 with top dart 30 locked in releasing sleeve 130 which in turn is locked to release adapter 120, from collet sleeve 100 and the remainder of top plug release assembly 54 which is secured to cementing head adapter 44.

As guide tube 300 is also threaded to release adapter 120, it will move downward inside inner casing 52 with top plug 56, and will normally remain in its extended position until top plug 56 encounters bottom plug 58 at the float collar or shoe at the bottom of casing 52, at which point bottom section 130 will encounter bottom dart 34, and retract or telescope upward relative to top plug 56, to its full extent in middle section 320, which in turn will retract or telescope into top section 310. At the same time, retaining sleeve 190 will move upwardly when encountering seat 204 on the top of bottom plug 58. The removal of guide tube 300 and retaining sleeve 190 as obstructions will permit seating of top plug 56 and specifically sleeve bottom 212 on seat 204 of bottom plug 58.

Thus it is apparent that a novel and unobvious improvement has been made in remote cementing plug launching devices. It should be understood that the present invention, while disclosed in the context of use offshore in a submerged well, is not so limited and has equal applicability onshore or wherever a remote cementing plug launching system is desired. While the invention has been described with respect to a preferred embodiment, many additions, deletions and modifications may be made. For example, the guide tube 300 may comprise woven wire, expanded metal or other non-solid sections; the guide tube may comprise a single long tube instead of telescoping sections, the tube being adapted to contract by virtue of its construction upon contact with a dart, such construction possibly being wire or deformable metal strips, or even a corrugated construction as in flexible hose; the invention may be employed with plug release mechanisms other than those in the preferred embodiment; more than two cementing plugs may be stacked and appropriately-sized darts used therewith for multiple-stage cementing operations employing cementing collars such as the Halliburton Services Multiple Stage Cementer, produced by Halliburton Services, Duncan, Oklahoma. These and other modifications may be made without departing from the spirit and scope of the invention as recited in the claims which follows:

I claim:

1. An improved remote cementing plug launching system, comprising:

a first cementing plug releasably secured to a plug release assembly;

a second cementing plug releasably secured to said first cementing plug; and collapsible guide tube means extending from said first cementing plug to a dart seat means in said second cement plug.

2. The apparatus of claim 1, wherein said guide tube means comprises a plurality of telescoping sections.

3. The apparatus of claim 2, wherein said guide tube means is secured to said first cementing plug.

4. The apparatus of claim 1, further including at least a third cementing plug releasably secured to said second cementing plug, and second collapsible guide tube means extending from said second cementing plug to a dart seat means in said third cementing plug.

5. The apparatus of claim 4, wherein said third cementing plug dart seat means defines a bore smaller than said second cementing plug dart seat means.

6. The apparatus of claim 5, wherein each of said guide tube means comprises a plurality of telescoping sections.

7. An improved cementing plug adapted to downward movement during the cementing of a well comprising:

a substantially cylindrical plug body having a plurality of annular wiper flaps disposed thereabout and a downward-facing cavity on the interior thereof; and guide tube means substantially axially disposed in said cavity of said plug body and extending downwardly therefrom, said guide tube means adapted to collapse upwardly into said cavity upon meeting an immovable obstruction during said downward movement.

8. The apparatus of claim 7, wherein said guide tube means comprises a plurality of telescoping sections.

9. An improved remote cementing plug release system, comprising:

a plurality of cementing plugs releasably secured to each other and to a plug release assembly above the uppermost of said cementing plugs in a well bore;

a dart seat means associated with each of said cementing plugs, each dart seat means having a greater diameter bore therethrough than the dart seat means immediately therebelow;

a plurality of plug release darts, each dart sized to seat in one of said dart seat means in sealing engagement therein; and collapsible dart guide means extending between each said cementing plug and the cementing plug immediately therebelow.

10. The apparatus of claim 9, wherein said dart guide means comprises tube means.

11. The apparatus of claim 10, wherein each of said dart guide means is secured at its top end to one of said cementing plugs.

12. The apparatus of claim 10, wherein said tube means comprises a plurality of telescoping sections.

13. The apparatus of claim 12, wherein said tube means is imperforate.

* * * * *